US005789716A

United States Patent [19]

Wang

[11] Patent Number: 5,789,716

[45] Date of Patent: Aug. 4, 1998

[54] ONE-WAY SHAKING SWITCH

[76] Inventor: Pi-Lin Wang, No. 47, F16, Pau-Chong Road, Shing Ten, Taipei, Taiwan

[21] Appl. No.: 748,227

[22] Filed: Nov. 12, 1996

[51] Int. Cl.[6] ..... H01H 35/14

[52] U.S. Cl. ..... 200/61.45 R; 200/61.48; 200/61.51

[58] Field of Search ..... 200/61.45 R, 61.48, 200/61.49, 61.5, 61.51, 61.52, 61.53, 61.45 M, 61.83, 276, 276.1

[56] References Cited

U.S. PATENT DOCUMENTS

| | | | |
|---|---|---|---|
| 3,649,787 | 3/1972 | Kasabian | 200/61.45 R |
| 3,657,500 | 4/1972 | Gawlick et al. | 200/61.45 R |
| 3,659,062 | 4/1972 | Shea | 200/61.45 R |
| 3,731,022 | 5/1973 | Loftus | 200/61.49 |
| 3,899,649 | 8/1975 | Jenkins | 200/61.51 |
| 4,210,789 | 7/1980 | Ushiku et al. | 200/61.45 R |
| 4,258,237 | 3/1981 | Beck | 200/11 J |
| 5,306,883 | 4/1994 | Manandhar et al. | 200/61.53 |
| 5,373,126 | 12/1994 | Manandhar et al. | 200/61.53 |

*Primary Examiner*—J. R. Scott
*Attorney, Agent, or Firm*—A & J

[57] ABSTRACT

A one-way shaking switch including a housing, a steel ball, a spring, a cover board and an upper and a lower metal terminals. The housing is integrally formed with a circular cavity, a transverse cavity and a longitudinal rectangular cavity disposed therebetween. Two steps are formed on two sides of the housing. Two pairs of posts are respectively symmetrically disposed on the steps. The lower terminal is fixedly inserted in the transverse cavity, the steel ball is placed in the circular cavity while the spring is disposed in the rectangular cavity. One end of the spring rides over a terminal leg of the lower terminal. The other end of the spring is disposed with a ring member depressing or retaining the steel ball. The upper terminal is placed on the steps of the housing over the lower terminal. The cover board is fixedly overlaid on the housing to secure the above elements in the housing. When the shaking switch is placed in a positive state, the weight and shaking force of the steel ball are loaded on the ring member of the spring, making the spring one-way swing to touch the upper terminal so as to electrically connect the upper terminal with the lower terminal. The resilience of the spring leads to continuous swinging of the spring, so as to intermittently contact with the upper terminal for achieving a flickering effect for a light emitting element.

4 Claims, 5 Drawing Sheets

ONE-WAY SHAKING SWITCH

BACKGROUND OF THE INVENTION

The present invention relates to a one-way shaking switch used in a light emitting element or circuit of a toy or other appliances. When shaked, the shaking switch is able to intermittently close a circuit for achieveing a flickering effect.

Various kinds of vibration switches have been developed. In former times, mercury is used as a medium for electrical connection. Hence, to obviate the problem of environment protection, a steel ball is used instead of mercury. In such shaking switch, two metal plates and a steel ball are enclosed in a housing and covered by a cover board. By means of vibration, the steel ball is shaked or rolled to electrically connect the two metal plates with each other.

Another type of shaking switch employs a spring which is swung to electrically connect two metal plates by higher accuracy than the vibration switch. Such shaking switch is shown in FIG. 1, wherein the shaking switch 100 includes a circuit board 11, a bow-shaped conductive plate 12, a channeled conductive plate 13, a spring 14, a steel ball 15, two metal terminal legs 16 and a transparent housing 17. The circuit board 11 is disposed in the housing 12 and the bow-shaped conductive plate 12 is disposed at one end of the circuit board, while the channeled conductive plate 13 is disposed at the other end thereof. The two conductive plates 12, 13 are soldered on the circuit board 11 so that each end of the conductive plates has solder blocks 121, 131. A U-shaped fixing seat 132 is disposed on the channeled conductive plate 13 and the spring 14 is placed and soldered in the fixing seat by a small inclination. Therefore, a solder block 133 is produced in the fixing seat. The steel ball 15 is fitted into the front end of the spring. The length of the spring 14 is equal to the distance between the conductive plates 11, 12 so that the steel ball 15 is positioned above the bow-shaped conductive plate 12. Each conductive plate 12, 13 has a downward extending terminal leg 16 adhered to the circuit board 11 and the housing 17 by adhesive agent 18.

When subject to shaking or vibration, the spring 14 is swung and the steel ball 15 continuously touches the bow-shaped conductive plate 12 to achieve a flickering effect.

Several shortcomings exist in such arrangement as follows:

1. The conductive plates 11, 12 and the spring 14 are fixed by soldering and the terminal legs 16 are adhered to the circuit board 11 and the housing 17 by adhesive agent. Such procedure is time-consuming.

2. The steel ball 15 must be fitted into the front end of the spring 14. It is difficult to perform this operation and the steel ball is apt to loosen from the spring. In order to avoid detachment of the steel ball, sometimes it is necessary to fix the steel ball by adhesive agent. However, this reduces the electrical conductivity between the steel ball and the spring.

3. The spring is soldered on the channeled conductive plate 12 by a certain inclination. It is difficult to adjust the inclination angle and secure the spring.

4. During transferring procedure, the spring is often shaked due to vibration or shaking to close the circuit. This causes waste of power.

SUMMARY OF THE INVENTION

It is therefore a primary object of the present invention to provide a one-way shaking switch including a housing, a steel ball, a spring, and an upper and a lower metal terminals which are disposed in the housing. The housing is covered by a cover board and integrally formed with a circular cavity, a transverse cavity and a longitudinal rectangular cavity disposed therebetween. Two steps are formed on two sides of the housing. Two pairs of posts are respectively symmetrically disposed on the steps. The lower terminal is fixedly inserted in the transverse cavity, the steel ball is placed in the circular cavity while the spring is disposed in the rectangular cavity. One end of the spring rides over a terminal leg of the lower terminal. The other end of the spring is disposed with a ting member depressing or retaining the steel ball. The upper terminal is placed on the steps of the housing over the lower terminal. The cover board is fixedly overlaid on the housing to secure the above elements in the housing.

The weight and shaking force of the steel ball are loaded on the ring member of the spring, making the spring one-way swing to touch the upper terminal so as to electrically connect the upper terminal with the lower terminal. The resilience of the spring leads to continuous swinging of the spring, so as to intermittently contact with the upper terminal for achieving a flickering effect.

The present invention has the following advantages:

1. In the case that the shaking switch is placed in a reversed or turned down state, it is uneasy to close the circuit so that the power will not be wasted during transferring procedure.

2. No circuit board is needed so that the cost is reduced.

3. The elements of the shaking switch are assembled with each other without soldering so that the shaking switch can be easily and quickly assembled.

4. It is unnecessary to fit the steel ball into the front end of the spring by an inclination so that the spring can be easily installed.

5. The volume of the present shaking switch is smaller than that of the conventional shaking switch so that the storage space is saved.

The present invention can be best understood through the following description and accompanying drawing, wherein:

DETAILED DESCRIPTION OF THE PREFERRED EMBODIMENT

Figure 1:
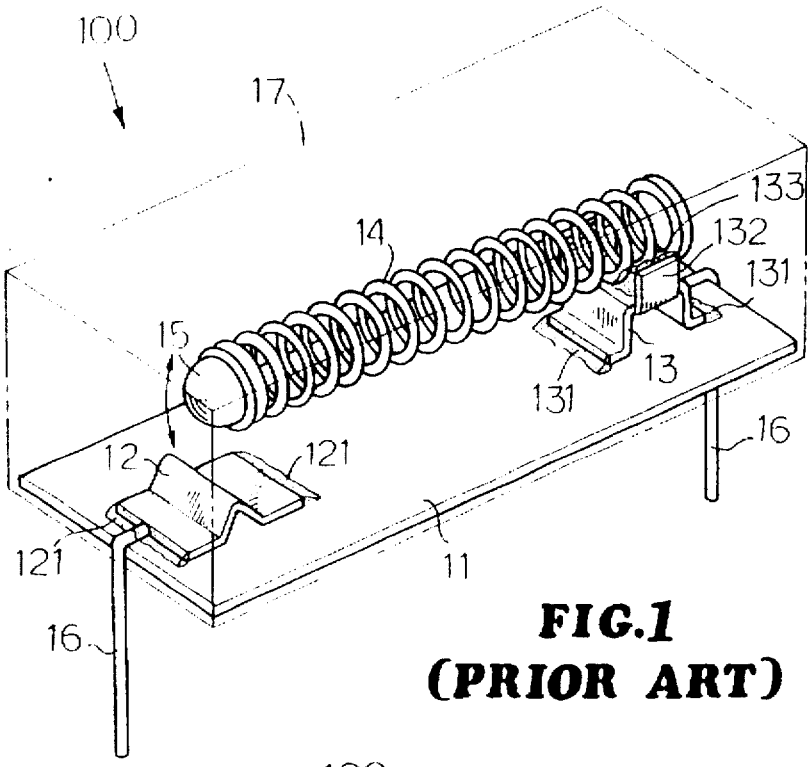
FIG.1 (PRIOR ART)
FIG. 1 shows a conventional shaking switch.
Figure 2:
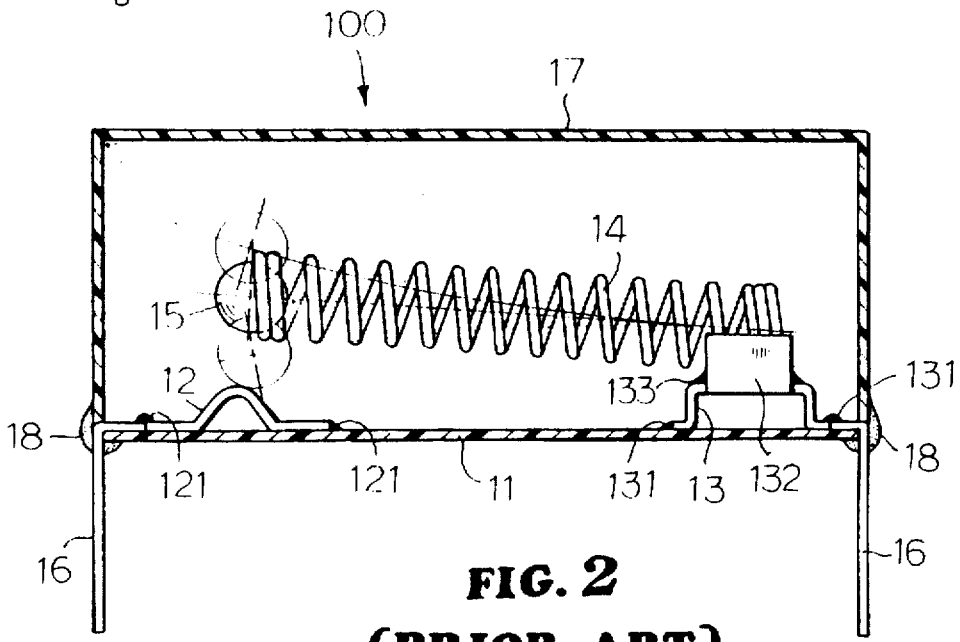
FIG. 2 (PRIOR ART)
FIG. 2 is a longitudinal sectional view of the conventional shaking switch.
Figure 3:
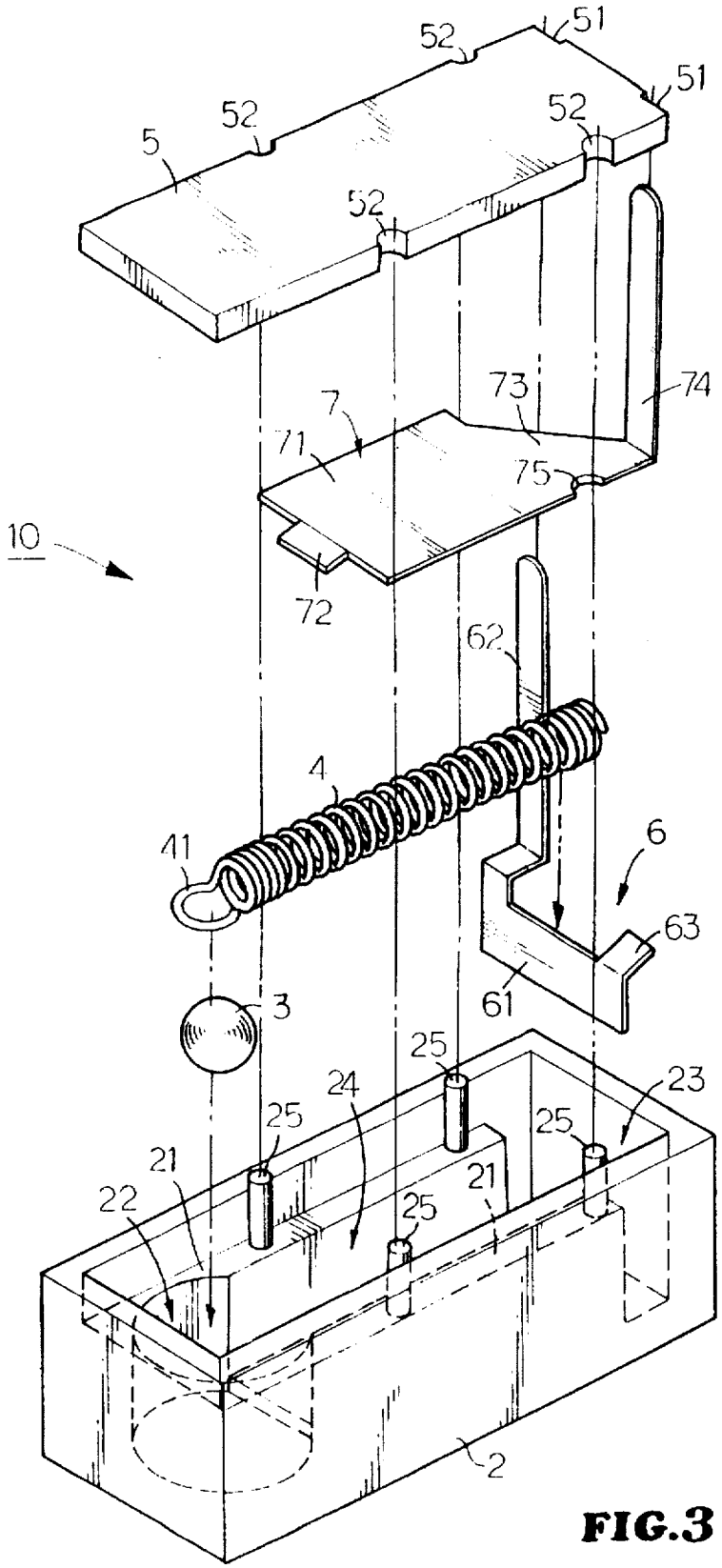
FIG. 3 is a perspective exploded view of the shaking switch of the present invention.

Please refer to FIG. 3. The shaking switch 10 of the present invention includes a rectangular plastic housing 2, a steel ball 3, a spring 4, a cover board 5 and two metal terminals 6, 7. The interior of the housing 2 is integrally composed of three cavities with different shapes. Two steps 21 are formed on two sides of the housing 2. The three cavities include a circular cavity 22, a transverse cavity 23 and a longitudinal rectangular cavity 24 disposed between the circular cavity 22 and the transverse cavity 23. The steps 21 are not extended into the transverse cavity. Two pairs of posts 25 are respectively symmetrically disposed on the steps 21.

Figure 4:
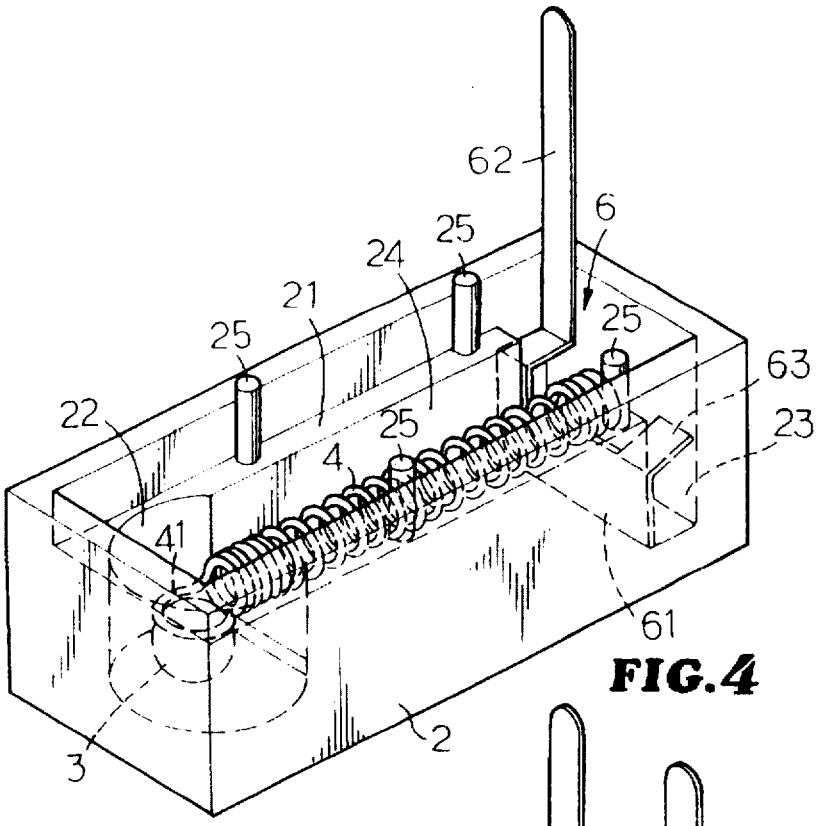
FIG. 4 shows a first step of assembling procedure of the present invention.
Figure 7:
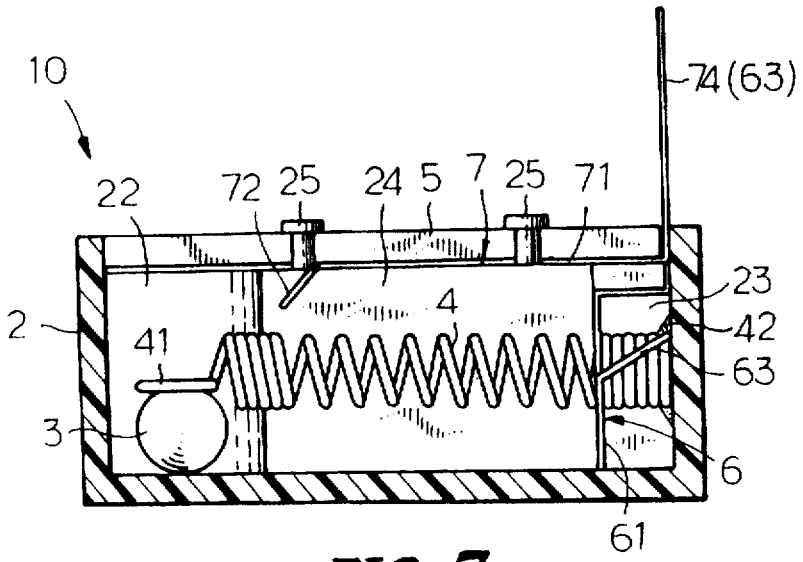
FIG. 7 is a sectional view taken along line A—A of FIG. 6, showing that the shaking switch is placed in a reversed state.

The lower terminal 6 is inserted into the transverse cavity 23. The lower terminal includes a transverse rectangular plate 61 and an L-shaped terminal leg 62 upward extending from one side of the rectangular plate 61. The other side of the rectangular plate 61 is disposed with an inclined engaging hook 63. After the lower terminal 6 is inserted into the transverse cavity 23, the engaging hook 63 is engaged therein to secure the lower terminal in the transverse cavity as shown in FIG. 4. The steel ball 3 is placed in the circular cavity 22 and the spring 4 is disposed in the rectangular cavity 24. One end of the spring is inserted on the rectangular plate 61 of the lower terminal 6. The end of the spring is fixed on inner wall of the housing 2 by adhesive agent 42 as shown in FIG. 7, locating the spring in a horizontal state. The other end of the spring 4 is disposed with a ring member 41 for bearing or retaining the steel ball 3 as shown in FIG. 4.

Figure 5:
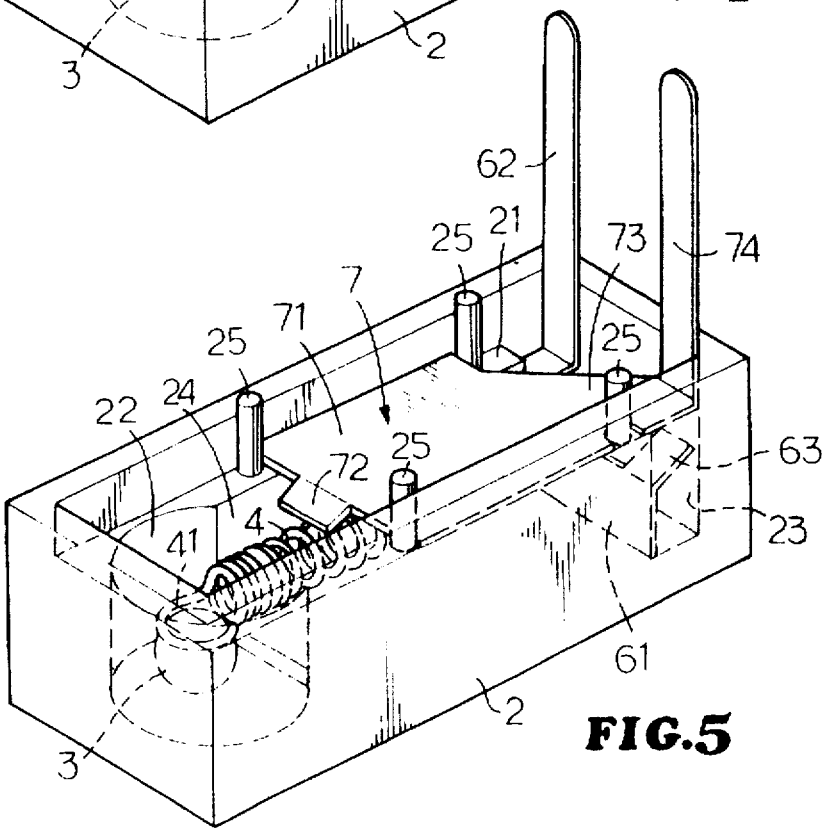
FIG. 5 shows a second step of assembling procedure of the present invention.

Referring to FIG. 5, after the above assembling procedure, the upper terminal 7 is placed on the steps 21 of the housing 2. The upper terminal 7 includes a horizontal rectangular plate 71, an inclined sensing plate 72 extending from front end of the rectangular plate 71, an oblique plate 73 at rear end of the rectangular plate 71 and a bent terminal leg 74 upward extending from the oblique plate. A semicircular notch 75 is formed on one side of the oblique plate behind the terminal leg 74. The upper terminal 7 is placed on the steps 21 with one post 25 passing through the notch 75. The oblique plate 73 provides a space permitting the terminal leg 62 of the lower terminal 6 to pass therethrough.

Figure 6:
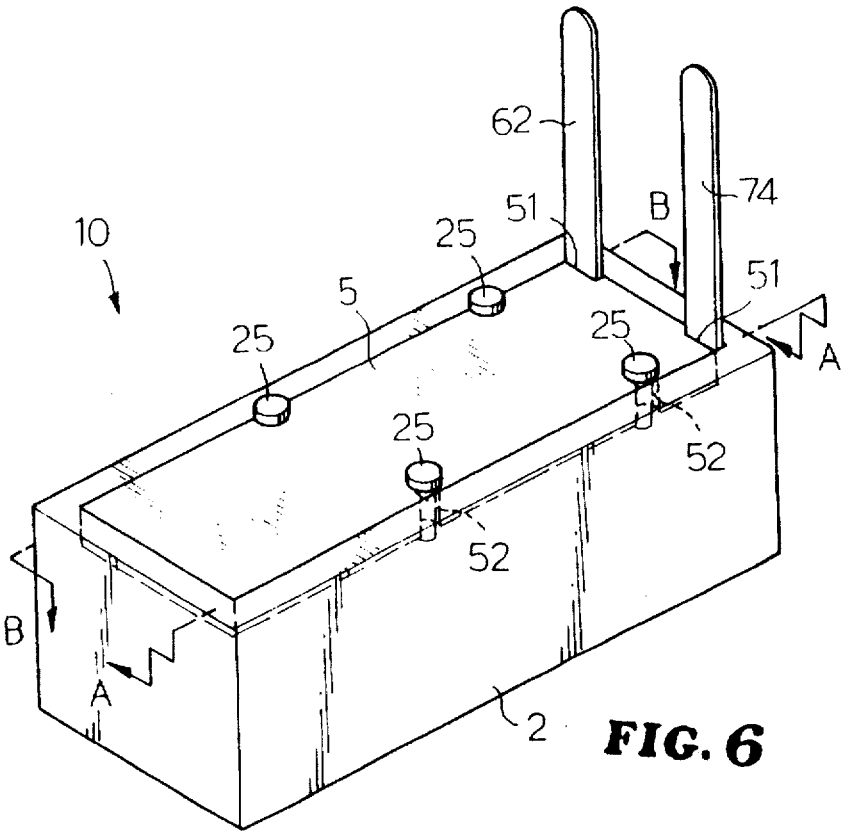
Fig. 6 shows a third step of assembling procedure of the present invention.

Referring to FIG. 6, the cover board 5 is overlaid on the upper side of the housing 2. Two sides of one end of the cover board 5 are respectively formed with two recesses 51 and each lateral side of the cover board 5 is formed with two semicircular notches 52. The terminal legs 74, 62 of the upper and lower terminals 7, 6 are passed through the recesses 51, while the four posts 25 of the housing 2 are passed through the four notches 52. The top ends of the posts 25 are punched flat by a punching machine, whereby the cover board 5 is associated with the housing 2 to close the opening thereof and secure the above elements in the housing 2. Accordingly, the present invention can be easily and quickly assembled.

Referring to FIG. 7 which is a sectional view taken along line A—A of FIG. 6, when the shaking switch 10 is placed in a reversed state, the steel ball 3 is rested on the bottom of the circular cavity 22 and the spring 4 is horizontally fixed on the wall of the housing. Therefore, in the case that the shaking switch is placed in a reverse state or a turned down state, the steel ball 3 is not subject to trembling due to shocking so that the front end of the spring 4 is not easy to touch the sensing plate 72 of the upper terminal 7, preventing the upper and lower terminals 7, 6 from electrically connecting with each other. Accordingly, during transferring, leakage of electricity is avoided.

Figure 8:
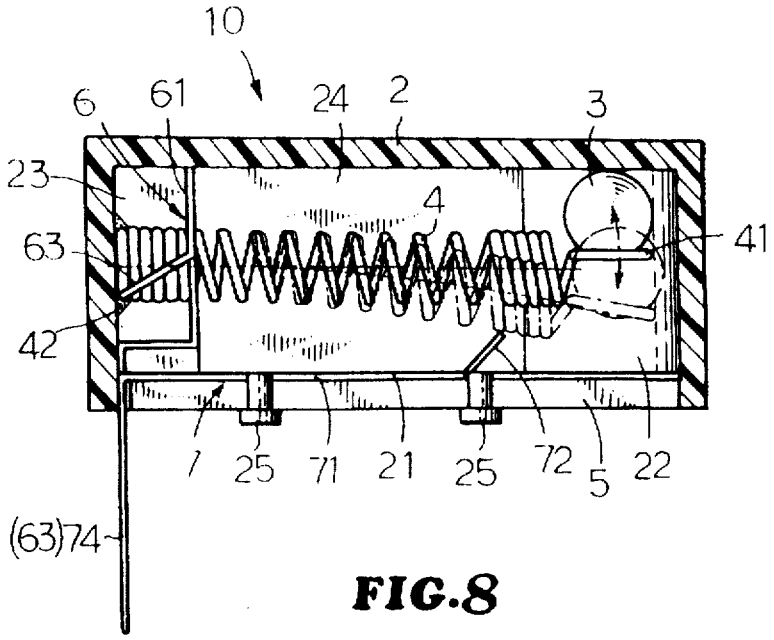
FIG. 8 is a sectional view taken along line A—A of FIG. 6, showing that the inverted shaking switch is placed in a positive state.

Referring to FIG. 8, when the shaking switch 10 is placed in a positive state, the weight and shaking force of the steel ball 3 will be loaded on the ring member 41 of the spring 4, making the spring 4 swing to touch the sensing plate 72 so as to electrically connect the upper terminal with the lower terminal. The resilience of the spring 4 leads to continuous swinging of the spring 4, whereby the front end of the spring 4 intermittently contacts with the sensing plate 72.

Figure 9:
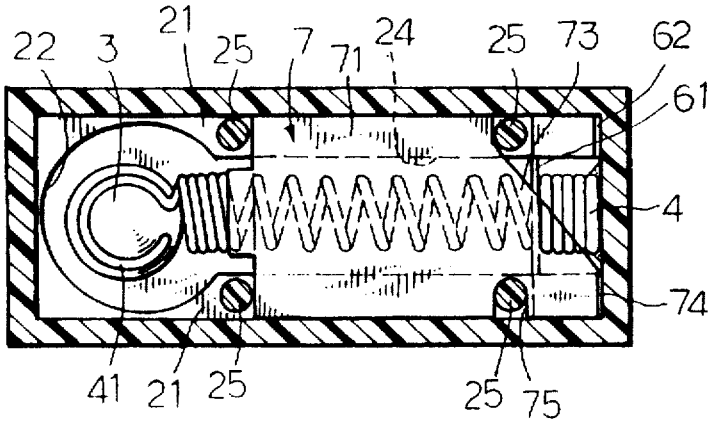
FIG. 9 is a sectional view taken along line B—B of FIG. 6.

Referring to FIG. 9 which is a sectional view taken along line B—B of FIG. 6, the steel ball 3 is displaceable within the circular cavity 22 of the housing 2. However, no matter how the steel ball 3 moves, the steel ball 3 is depressed by the ring member so that each movement of the steel ball leads to swinging of the spring which intermittently touches the sensing plate 72.

It is to be understood that the above description and drawings are only used for illustrating one embodiment of the present invention, not intended to limit the scope thereof. Any variation and derivation from the above description and drawings should be included in the scope of the present invention.

What is claimed is:

1. A one-way shaking switch comprising a housing, a steel ball, a spring, a cover board and an upper and a lower metal terminals, said shaking switch being characterized in that:

an interior of the housing is integrally formed with a circular cavity, a transverse cavity and a longitudinal rectangular cavity disposed between the circular cavity and the transverse cavity, two steps being formed on two sides of the housing without extending into the transverse cavity, two pairs of posts being respectively symmetrically disposed on the steps;

the lower terminal is inserted and secured in the transverse cavity of the housing, the steel ball being placed in the circular cavity and the spring being disposed in the rectangular cavity, one end of the spring riding over a terminal leg of the lower terminal, the other end of the spring being disposed with a ring member bearing or retaining the steel ball; and the upper terminal is placed on the steps of the housing over the lower terminal, the cover board being overlaid on the upper side of the housing to close an opening thereof in the top ends of the posts being punched flat to fixedly associate the cover board with the housing.

2. A shaking switch as claimed in claim 1, wherein the upper terminal includes a horizontal rectangular plate, an inclined sensing plate extending from the front end of the rectangular plate, an oblique plate at rear end of the rectangular plate and a terminal leg upward extending from the oblique plate, a semicircular notch being formed on one side of the oblique plate behind the terminal leg.

3. A shaking switch as claimed in claim 1, wherein the lower terminal includes a transverse rectangular plate and an L-shaped terminal leg upward extending from one side of the rectangular plate, the other side thereof being disposed with an inclined engaging hook.

4. A shaking switch as claimed in claim 1, wherein two sides of one end of the cover board are respectively formed with two recesses and each lateral side of the cover board is formed with two semicircular notches.

* * * * *